US011801450B2

(12) United States Patent
Xiao

(10) Patent No.: US 11,801,450 B2
(45) Date of Patent: Oct. 31, 2023

(54) SOAP BUBBLE MAKER AND INFLATABLE AMUSEMENT DEVICE COMPRISING THE SAME

(71) Applicant: Swiftech Company Ltd., Zhongshan (CN)

(72) Inventor: Jiansheng Xiao, Zhongshan (CN)

(73) Assignee: SWIFTECH COMPANY LTD., Zhongshan (CN)

( * ) Notice: Subject to any disclaimer, the term of this patent is extended or adjusted under 35 U.S.C. 154(b) by 212 days.

(21) Appl. No.: 17/529,251

(22) Filed: Nov. 17, 2021

(65) Prior Publication Data

US 2022/0096950 A1 Mar. 31, 2022

Related U.S. Application Data

(63) Continuation-in-part of application No. PCT/CN2021/089651, filed on Apr. 25, 2021.

(30) Foreign Application Priority Data

Sep. 29, 2020 (CN) ..... 202011049535.X

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS

| | | | | |
|---|---|---|---|---|
| 2,587,895 | A * | 3/1952 | Quinn, Jr. | A63H 33/28 261/121.1 |
| 2,711,612 | A * | 6/1955 | Wister | A63H 33/28 239/367 |
| 4,787,875 | A * | 11/1988 | Baron | A63H 33/28 239/289 |
| 6,558,223 | B1 * | 5/2003 | Matthews | A63H 33/28 446/159 |
| 2003/0027482 | A1 * | 2/2003 | Dumigan | A63H 33/3055 446/74 |
| 2020/0070191 | A1 * | 3/2020 | Myers | A23F 5/00 |

* cited by examiner

*Primary Examiner* — John A Ricci
(74) *Attorney, Agent, or Firm* — MATTHIAS SCHOLL P.C.; Matthias Scholl

(57) ABSTRACT

A bubble maker includes a pressurized container; a liquid storage bag; a bubble generator; and a drainage tube connecting the liquid storage bag and the bubble generator. The liquid storage bag is configured to store a bubble solution. The drainage tube is configured to convey the bubble solution to the bubble generator; and the bubble generator is configured to convert the bubble solution into bubbles. The liquid storage bag includes elastic material and is disposed in the pressurized container. The pressured container includes a fluid inlet so that a fluid is introduced to the pressured container via the fluid inlet to squeeze the liquid storage bag, and thus the bubble solution in the liquid storage bag is squeezed into the bubble generator via the drainage tube.

9 Claims, 2 Drawing Sheets

SOAP BUBBLE MAKER AND INFLATABLE AMUSEMENT DEVICE COMPRISING THE SAME

CROSS-REFERENCE TO RELATED APPLICATIONS

This application is a continuation-in-part of International Patent Application No. PCT/CN2021/089651 with an international filing date of Apr. 25, 2021, designating the United States, now pending, and further claims foreign priority benefits to Chinese Patent Application No. 202011049535.X filed Sep. 29, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a bubble maker and an inflatable amusement device comprising the same.

Inflatable castles (also called closed inflatable trampolines (CITs), bouncing castle, bouncy houses, bounce houses, jumping castle, jumper, bouncy castles, moon bounces, or moonwalks) are temporary inflatable structures and buildings for recreational purposes, particularly for children. A soap bubble maker is designed to produce a succession of soap bubbles, typically used for entertainment at children's parties, concerts, etc. To produce bubbles while playing in the inflatable castles, people load the bubble maker to the inflatable amusement device.

For the bubble maker to produce bubbles continuously, the volume of the container or liquid storage bag storing soap water needs to be large. After the container or liquid storage bag is filled with soap water, it is very heavy and inconvenient to load on the inflatable amusement device. In addition, to achieve a better bubble effect, the bubble maker is generally disposed much higher than the inflatable amusement device, which further increases the difficulty to install the bulky container or liquid storage bag storing soap water on the inflatable castle.

SUMMARY

The disclosure provides a bubble maker, comprising a pressurized container; a liquid storage bag; a bubble generator; and a drainage tube connecting the liquid storage bag and the bubble generator. The liquid storage bag is configured to store a bubble solution; the drainage tube is configured to convey the bubble solution to the bubble generator; and the bubble generator is configured to convert the bubble solution into bubbles; the liquid storage bag comprises elastic material and is disposed in the pressurized container; the pressured container comprises a fluid inlet so that a fluid is introduced to the pressured container via the fluid inlet to squeeze the liquid storage bag, and thus the bubble solution in the liquid storage bag is squeezed into the bubble generator via the drainage tube.

In another aspect, the disclosure provides an inflatable amusement device, comprising an inflatable body, an air charging apparatus configured to add air to the inflatable body, and the abovementioned bubble maker; the bubble generator of the bubble maker is disposed on the inflatable body, and the liquid storage bag is disposed in or on one side of the inflatable body.

The following advantages are associated with the bubble maker and the inflatable amusement device comprising the same of the disclosure. When in use, the fluid such as tap water or gas such as air produced by the blower is continuously introduced to the pressurized container via the fluid inlet, and the tap water or air acts on the liquid storage bag and squeezes the soap water stored in the liquid storage bag to flow into the bubble generator via the drainage tube, and thus the bubbles are formed in the bubble generator and float above the inflatable body for recreation.

DETAILED DESCRIPTION

To further illustrate, embodiments detailing a bubble maker and an inflatable amusement device comprising the same are described below. It should be noted that the following embodiments are intended to describe and not to limit the disclosure.

Figure 1:
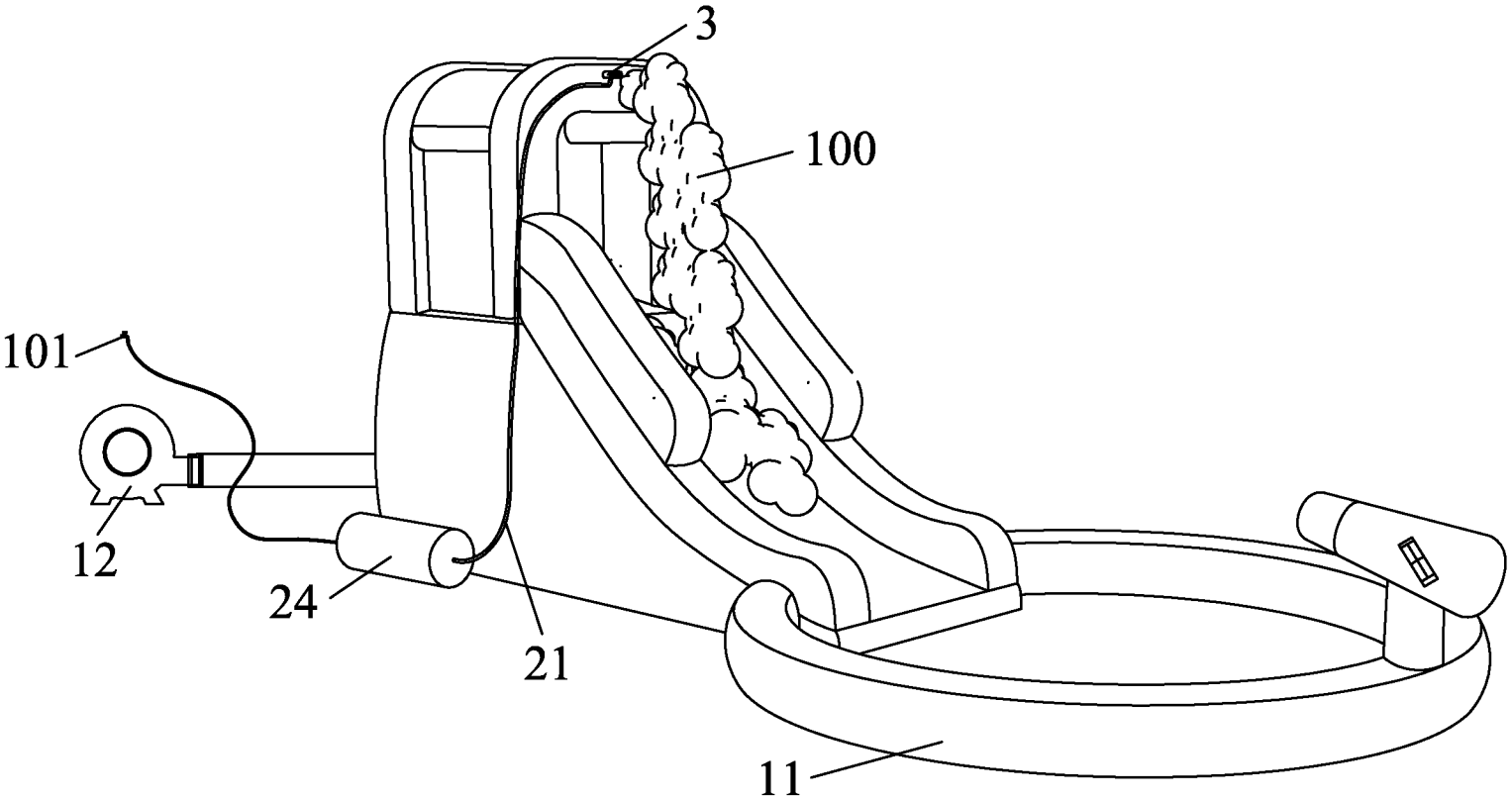
FIG. 1 is a schematic diagram of an inflatable amusement device of the disclosure.

As shown in FIG. 1, the disclosure provides an inflatable amusement device comprising an inflatable body 11, an air charging apparatus 12 configured to add air to the inflatable body 11, and a bubble maker 2.

Figure 2:
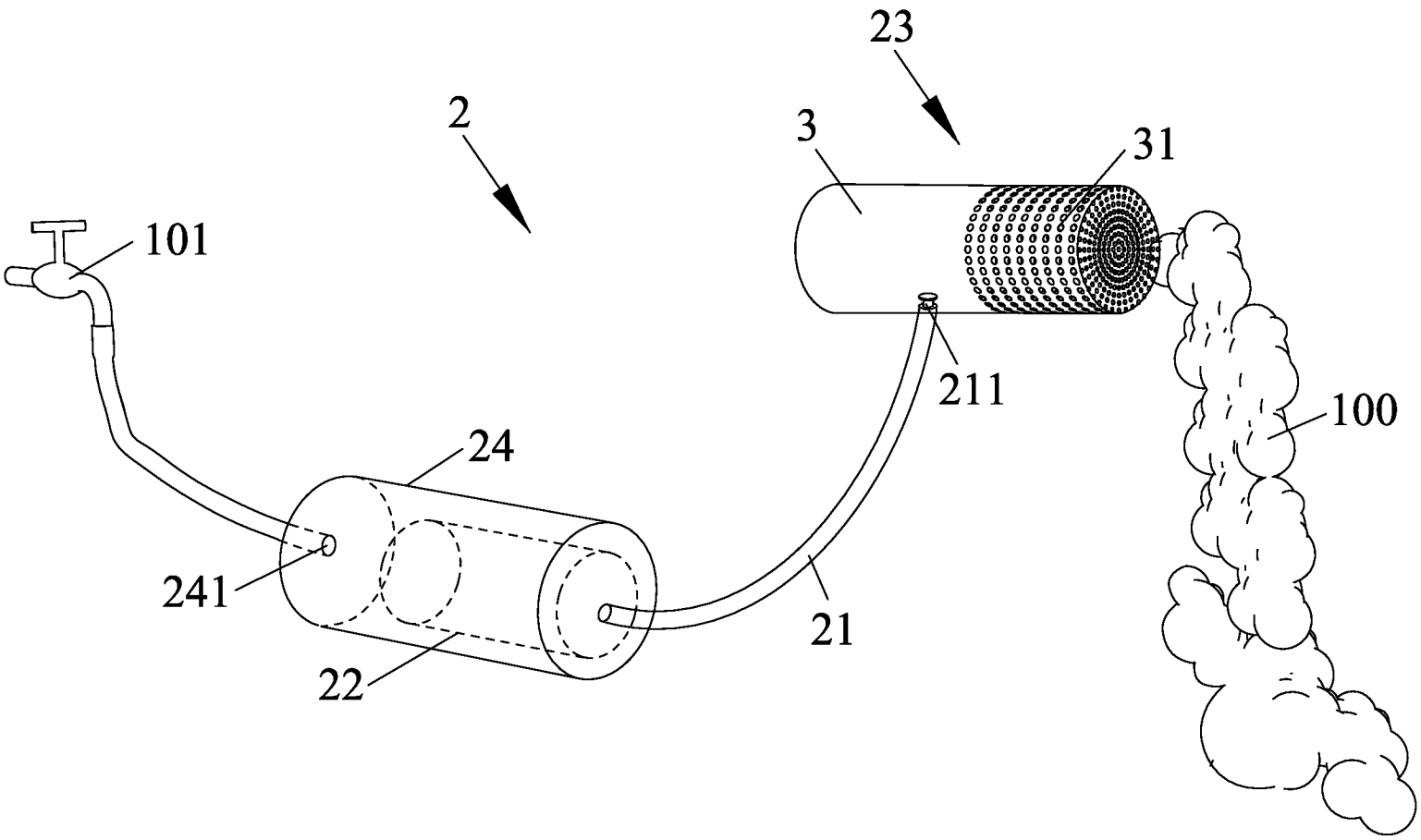
FIG. 2 is a schematic diagram of a bubble maker of the disclosure.

As shown in FIG. 2, the bubble maker comprises a pressurized container 24; a liquid storage bag 22; a bubble generator 23; and a drainage tube 21 connecting the liquid storage bag 22 and the bubble generator 23. The liquid storage bag 22 is configured to store a bubble solution; the drainage tube 21 is configured to convey the bubble solution to the bubble generator 23; and the bubble generator 23 is configured to convert the bubble solution into bubbles; the liquid storage bag 22 comprises elastic material and is disposed in the pressurized container 24; the pressured container 24 comprises a fluid inlet 241 so that a fluid is introduced to the pressured container via the fluid inlet to squeeze the liquid storage bag 22, and thus the bubble solution in the liquid storage bag 22 is squeezed into the bubble generator 23 via the drainage tube 21.

The pressurized container 24 comprises hard or soft material, preferably, soft material. Likewise, the liquid storage bag 22 comprises soft material.

The pressurized container 24 is cylindrical in an inflated state, and the liquid storage bag 22 is cylindrical when filled with the bubble solution. The fluid inlet 241 is disposed on the rear end of the pressurized container 24, and the drainage tube 21 passes through the front end of the pressurized container 24 and is connected to the front end of the liquid storage bag 22.

When the fluid is continuously added to the pressurized container 24 via the fluid inlet 241, the inner cavity pressure of the pressurized container 24 increases. When the inner cavity pressure of the pressurized container 24 is greater than the inner cavity pressure of the liquid storage bag 22, the bubble solution in the liquid storage bag 22 flows to the drainage tube 21. The pressurized container 24 and the liquid storage bag 22 are designed as a cylinder, and the fluid inlet 241 is disposed oppositely to the drainage tube 21 with respect to the liquid storage bag 22, which is conducive to the fluid in the pressurized container 24 to apply pressure to the liquid storage bag 22, to facilitate the outflow of the bubble solution to the drainage tube 21.

The bubble maker can be used alone. In this way, the bubble generator 23 comprises a cylindrical housing 3; a net is disposed or formed on a first end of the cylindrical housing 3, and a blower is disposed on a second end of the cylindrical housing 3; the blower comprises an air outlet facing the net; the drainage tube 21 comprises a first end connected to the liquid storage bag 22 and a second end extending into the cylindrical housing 3; and a nozzle 211 is disposed on the second end of the drainage tube 21. The bubble solution flows into the bubble generator 23 via the drainage tube 21, is sprayed on the mesh 31 by the nozzle, and blown by the air produced by the blower to form bubbles 100.

In this example, the bubble maker 2 is disposed on an inflatable castle. Optionally, the inflatable body 11 is not limited to a single shape, and can be in the form of a jumping castle with various shapes. Thus, the bubble generator 23 is disposed on the inflatable body 11 in the form of a jumping castle, and the liquid storage bag 22 is disposed in or on one side of the inflatable body 11.

The bubble generator 23 comprises a cylindrical housing 3 disposed on the inflatable body 11; a net 31 is disposed or formed on a first end of the cylindrical housing 3, and a second end of the cylindrical housing 3 communicates with the inner cavity of the inflatable body 11 without the arrangement of a blower; the drainage tube 21 comprises a first end connected to the liquid storage bag 22 and a second end extending into the cylindrical housing 3; and a nozzle 211 is disposed on the second end of the drainage tube 21. The bubble solution flows into the bubble generator 23 via the drainage tube 21, is sprayed on the mesh 31 by the nozzle, and blown by the air in the inner cavity of the inflatable body 11 to form bubbles 100.

The fluid is tap water or gas, particularly, tap water. On the one hand, all amusement parks are equipped with tap water. Thus, it is only necessary to connect a tap 101 and the fluid inlet 241 through a pipe. On the other hand, the tap water itself has pressure and can continuously flow to the pressurized container 24 to act on the liquid storage bag 22 and squeeze the soap water stored in the liquid storage bag 22. The design is simple and is easy to operate.

In addition, the pressurized container 24 is equipped with a pressure relief valve. When the inlet water pressure or gas pressure in the pressurized container 24 is too high, the pressure relief valve will automatically open to release water and pressure, thus ensuring the pressurized container 24 will not burst and ensuring safety.

It will be obvious to those skilled in the art that changes and modifications may be made, and therefore, the aim in the appended claims is to cover all such changes and modifications.

What is claimed is:

1. A bubble maker, comprising:

a pressurized container;

a liquid storage bag;

a bubble generator; and a drainage tube connecting the liquid storage bag and the bubble generator;

wherein:

the liquid storage bag is configured to store a bubble solution; the drainage tube is configured to convey the bubble solution to the bubble generator; and the bubble generator is configured to convert the bubble solution into bubbles;

the liquid storage bag comprises elastic material and is disposed in the pressurized container; and the pressured container comprises a fluid inlet so that a fluid is introduced to the pressured container via the fluid inlet to squeeze the liquid storage bag, and thus the bubble solution in the liquid storage bag is squeezed into the bubble generator via the drainage tube.

2. The bubble maker of claim 1, wherein the pressurized container comprises soft material.

3. The bubble maker of claim 1, wherein the pressurized container is equipped with a pressure relief valve.

4. The bubble maker of claim 1, wherein the fluid is tap water or gas.

5. The bubble maker of claim 1, wherein the pressurized container is cylindrical in an inflated state, and the liquid storage bag is cylindrical when filled with the bubble solution.

6. The bubble maker of claim 5, wherein the fluid inlet is disposed on a rear end of the pressurized container, and the drainage tube passes through a front end of the pressurized container and is connected to a front end of the liquid storage bag.

7. The bubble maker of claim 5, wherein the bubble generator comprises a cylindrical housing; a net is disposed or formed on a first end of the cylindrical housing, and a blower is disposed on a second end of the cylindrical housing; the blower comprises an air outlet facing the net; the drainage tube comprises a first end connected to the liquid storage bag and a second end extending into the cylindrical housing; and a nozzle is disposed on the second end of the drainage tube.

8. An inflatable amusement device, comprising an inflatable body, an air charging apparatus configured to add air to the inflatable body, and the bubble maker of claim 1; wherein the bubble generator of the bubble maker is disposed on the inflatable body, and the liquid storage bag is disposed in or on one side of the inflatable body.

9. The device of claim 8, wherein the bubble generator comprises a cylindrical housing disposed on the inflatable body; a net is disposed or formed on a first end of the cylindrical housing, and a second end of the cylindrical housing communicates with an inner cavity of the inflatable body; the drainage tube comprises a first end connected to the liquid storage bag and a second end extending into the cylindrical housing; and a nozzle is disposed on the second end of the drainage tube.

* * * * *